United States Patent [19]

Wittman et al.

[11] Patent Number: 5,038,677

[45] Date of Patent: Aug. 13, 1991

[54] CAN CRUSHER WITH CRIMPING MEMBER

[75] Inventors: Boyd Wittman; Barry L. Gregerson, both of Shorewood, Minn.

[73] Assignee: Empak, Inc., Chanhassen, Minn.

[21] Appl. No.: 403,883

[22] Filed: Sep. 7, 1989

[51] Int. Cl.[5] ..... B30B 9/32

[52] U.S. Cl. ..... 100/137; 100/233; 100/293; 100/902

[58] Field of Search ..... 100/902, 137, 218, 233, 100/293, 35, 41, 42, 98 R

[56] References Cited

U.S. PATENT DOCUMENTS

| | | | |
|---|---|---|---|
| 3,667,386 | 6/1972 | Workman | 100/902 X |
| 3,988,978 | 11/1976 | Flick | 100/902 X |
| 4,383,480 | 5/1983 | Jerden | 100/902 X |
| 4,394,834 | 7/1983 | Lowe | 100/293 X |
| 4,403,545 | 9/1983 | Toburen et al. | 100/293 X |
| 4,415,395 | 11/1983 | Paque | 100/98 R X |
| 4,569,281 | 2/1986 | Woods | 100/902 X |
| 4,653,398 | 3/1987 | Fowler | 100/902 X |

*Primary Examiner*—Harvey C. Hornsby
*Assistant Examiner*—Stephen F. Gerrity
*Attorney, Agent, or Firm*—Hugh D. Jaeger

[57] ABSTRACT

A can crusher for compacting cans, such as aluminum soft drink cans, into a substantially flat configuration for storage, recycling or disposal. The can crusher includes a base with opposing flanges and a handle which rotates about the flanges. The handle includes an extending crimping member which compresses the center of the can downwardly, and also forces the ends of the can inwardly. The handle also includes a flat surface which then flattens and rotates the ends of the can towards a mid-portion of the can into a substantially flat configuration. The first action of the extending crimping member against the can and the second action of the flat surface against the can crush the can into a substantially flat can which is environmentally and ecologically useful in recycling processes. The crushed can consumes less space in recycling operations or disposal, and environmentally and ecologically presents itself in a more pleasing manner for recycling or disposal.

7 Claims, 17 Drawing Sheets

CAN CRUSHER WITH CRIMPING MEMBER

BACKGROUND OF THE INVENTION

1. Field of the Invention

The present invention pertains to a can crusher, and more particularly, pertains to a can crusher for soda cans, pop cans, or like cans, whether the cans be aluminum or steel. The can crusher is manually operated by an individual.

2. Description of the Prior Art

Prior art methods of crushing cans, such as soda cans or pop cans, have included manufactured can crushers that crush can top to bottom, a brute force hand method, where the can is crushed by one's mere physical strength of the hands; a foot stomping approach, where the can is literally stomped on by an individual until the can is flattened; or a physical tool approach, where a hammer or like instrument is used to flatten the can. All of these methods are rather crude and barbaric, and are not considered as high technology compacting for subsequent recycling or disposal of a can.

The present invention provides a can crusher which is "state-of-the-art" technology to environmentally and ecologically crush a can from the side which reduces force required to crush the can versus top to bottom by any individual having basic physical strength and basic motor sensory physical skills.

SUMMARY OF THE INVENTION

The general purpose of the present invention is to provide a can crusher which crushes cans from the side, particularly pop cans or soda cans. The cans can be aluminum cans, steel cans, or any alloy thereof.

According to one embodiment of the present invention, there is provided a can crusher, including a base with opposing flanges, a handle, and opposing pivot pins inserted through the flanges and into the handle providing for rotational movement of the handle about the rotational axis of the pivot pins. The base includes an indentation structure for receiving a can. The handle includes an extending crimping member for a first operation of midsection crushing operation of the can. The handle also includes a flat surface 90 degrees adjacent to the crimping member on the other side of the handle for a second operation of end crushing operation of the can after the extending crimping member crushes and passes through a mid-portion of the can.

Significant aspects and features of the present invention include a can crusher for crushing of pop cans or soda cans, particularly aluminum cans from the side.

Another significant aspect and feature of the present invention is a can crusher which can be used to crush beer cans, particularly the ever popular twelve ounce aluminum beer can.

A further significant aspect and feature of the present invention is a can crusher which provides a crushed can which is environmentally and ecologically pleasing in further providing a crushed can which takes up a least amount of physical space for recycling or disposal.

Having thus described the embodiments of the present invention, it is the principal object hereof to provide a can crusher for crushing of cans to a substantially flat configuration.

One object of the present invention is to crush cans to consume a least amount of space.

Another object of the present invention is to crush cans for recycling purposes.

A further object of the present invention is to crush cans so as to be environmentally and ecologically efficient for subsequent recycling of the cans, such as aluminum beer cans or aluminum pop cans.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
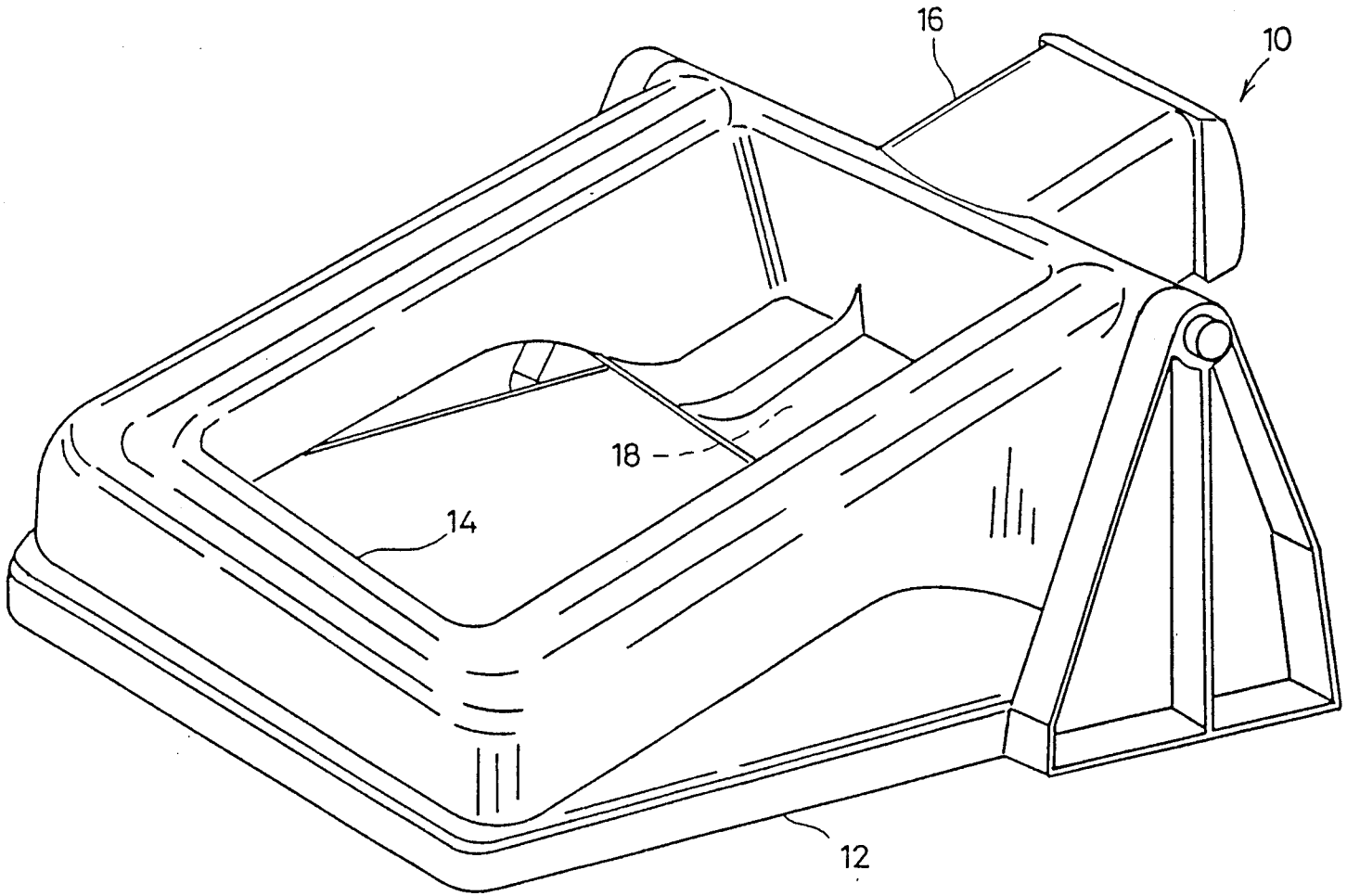
FIG. 1 illustrates a perspective view of a can crusher, the present invention.

FIG. 1 illustrates a top perspective view of a can crusher 10, the present invention, including a base 12 and a handle 14, including an extending crimping member 16 and a flat surface 18.

Figure 2:
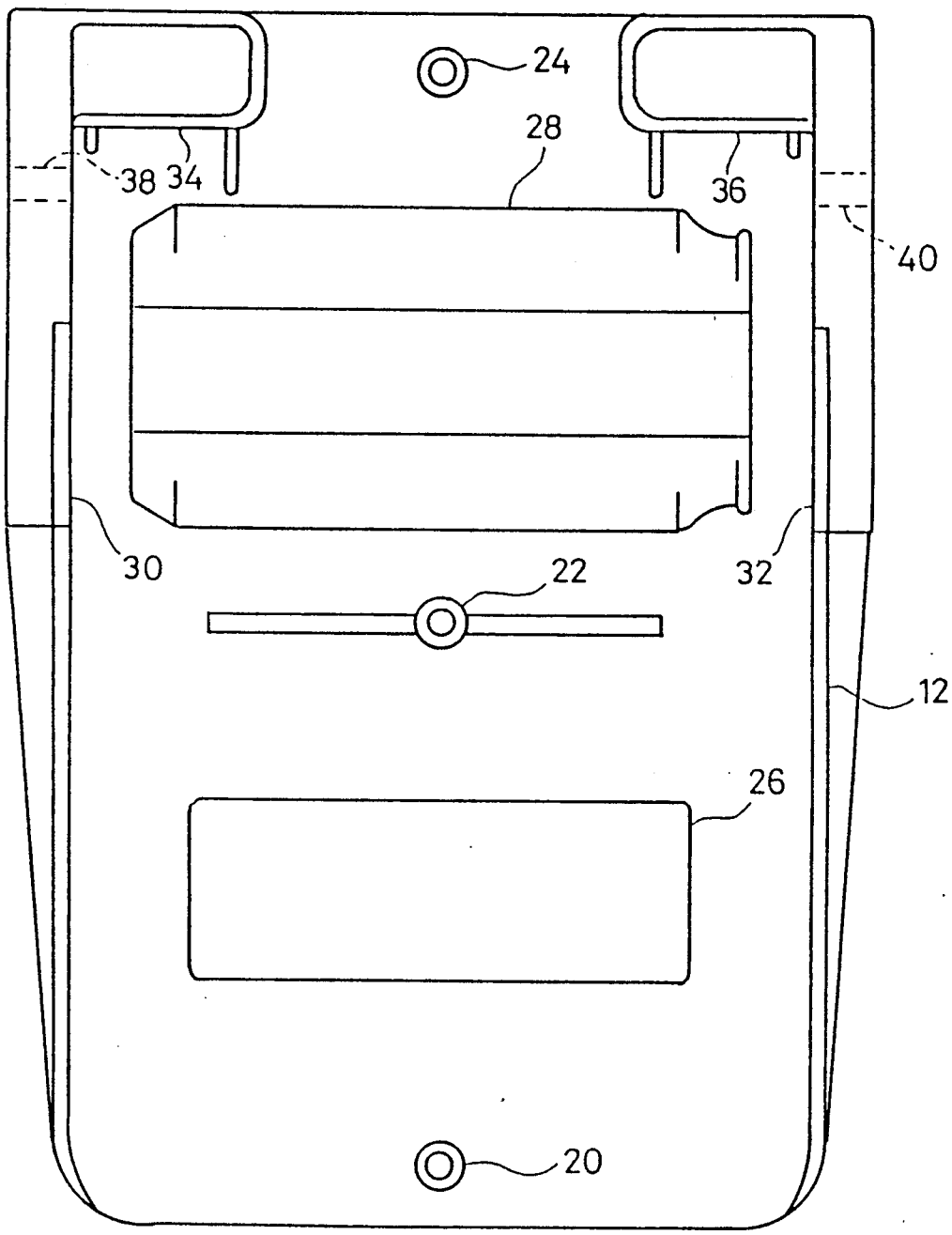
FIG. 2 illustrates a top view of the base.

FIG. 2 illustrates a top view of the base 12 including countersunk screw holes 20, 22 and 24, an indented label area 26, a longitudinal recessed area 28 for accepting a can, opposing flanges 30 and 32, and opposing support members 34 and 36. Holes 38 and 40 in the opposing flanges 30 and 32 accept rotational pins 42 and 44 for pivoting of the handle 14 as later described in detail. A member 23 assists in maintaining the can in position during a crushing operation.

Figure 3:
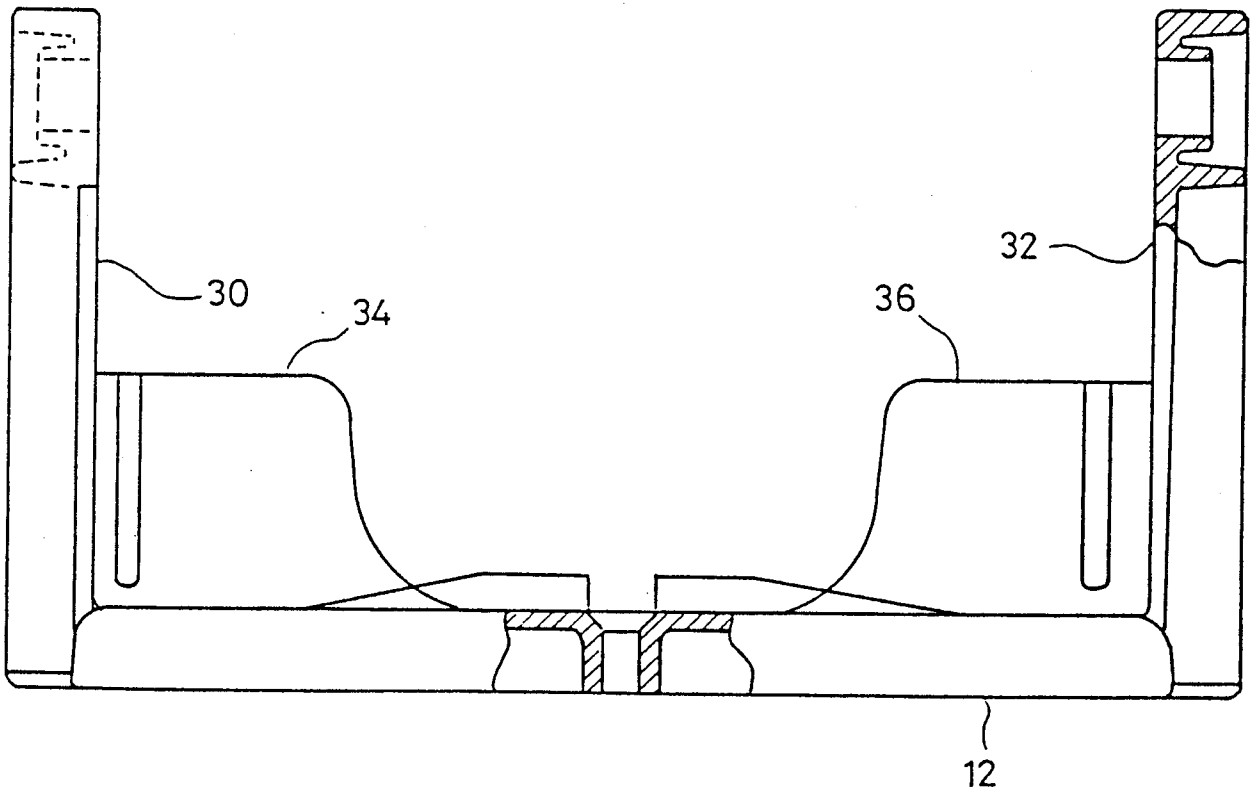
FIG. 3 illustrates a front view of the base.

FIG. 3 illustrates a front view of the base 12 where all numerals correspond to those elements previously described.

Figure 4:
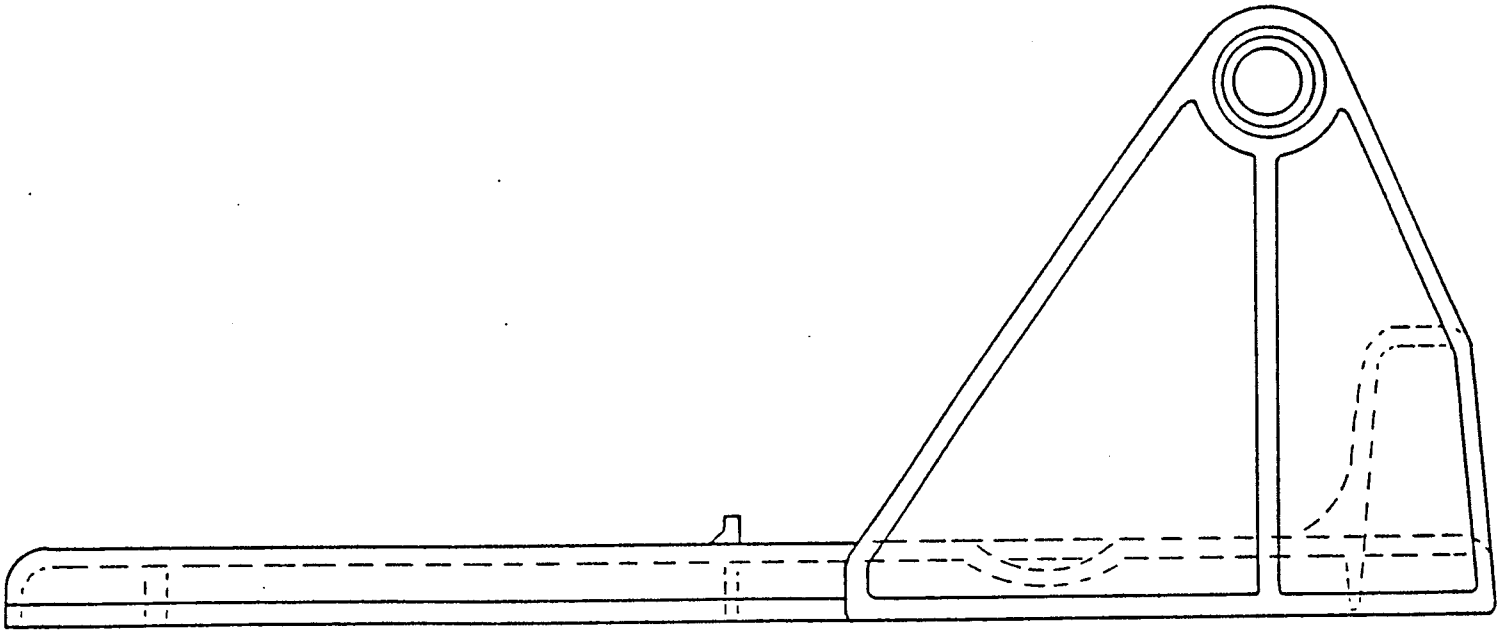
FIG. 4 illustrates a right side view of the base.

FIG. 4 illustrates a right side view of the base 12 where all numerals correspond to those elements previously described including a plurality of supporting ribs by way of example and for purposes of illustration only.

Figure 5:
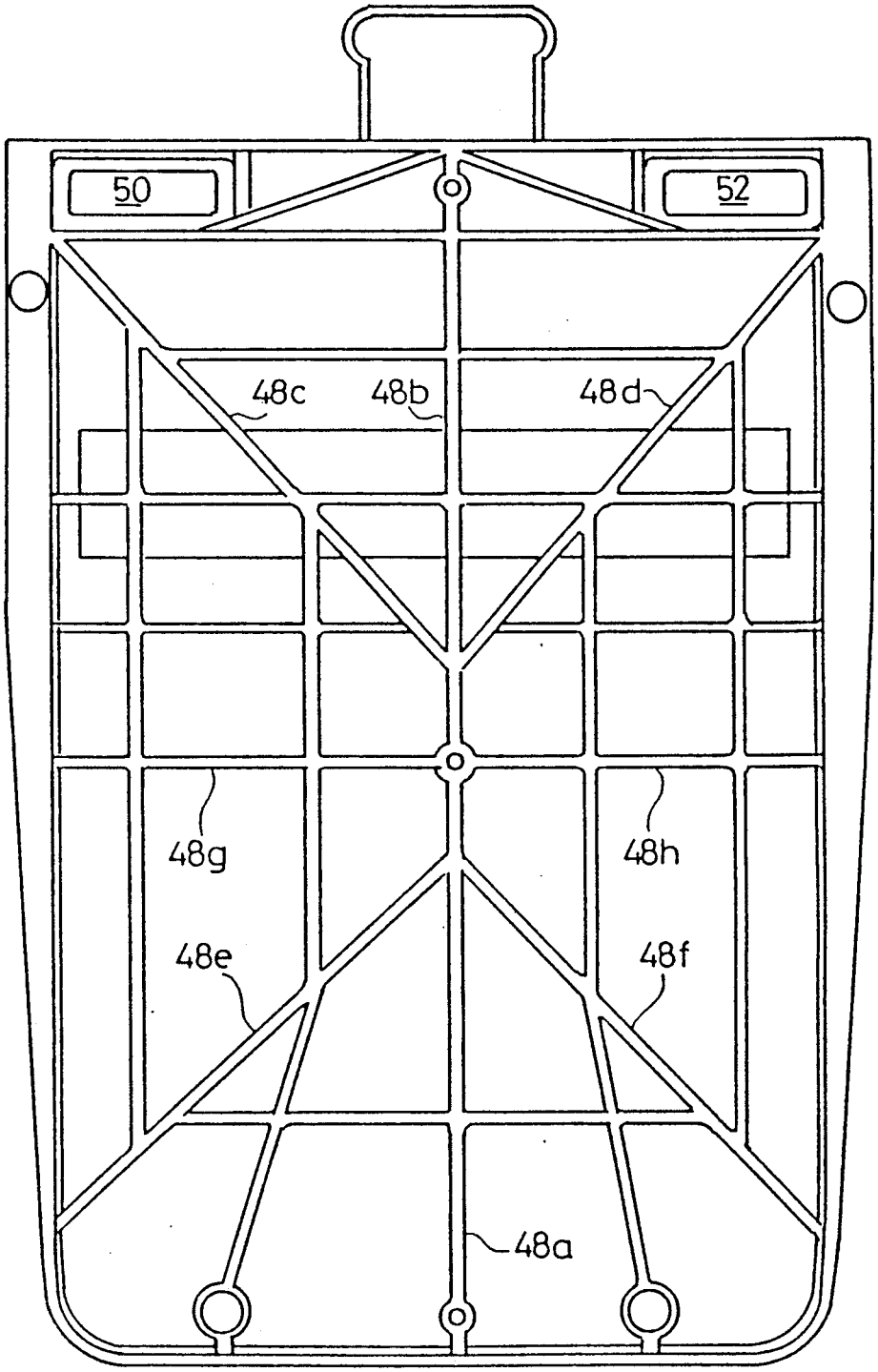
FIG. 5 illustrates a bottom view of the base.

FIG. 5 illustrates a bottom view of the base 12 with a plurality of reinforcing ribs 48*a*–48*n*. Mold voids 50 and 52 are provided to conserve the amount of molded material.

Figure 6:
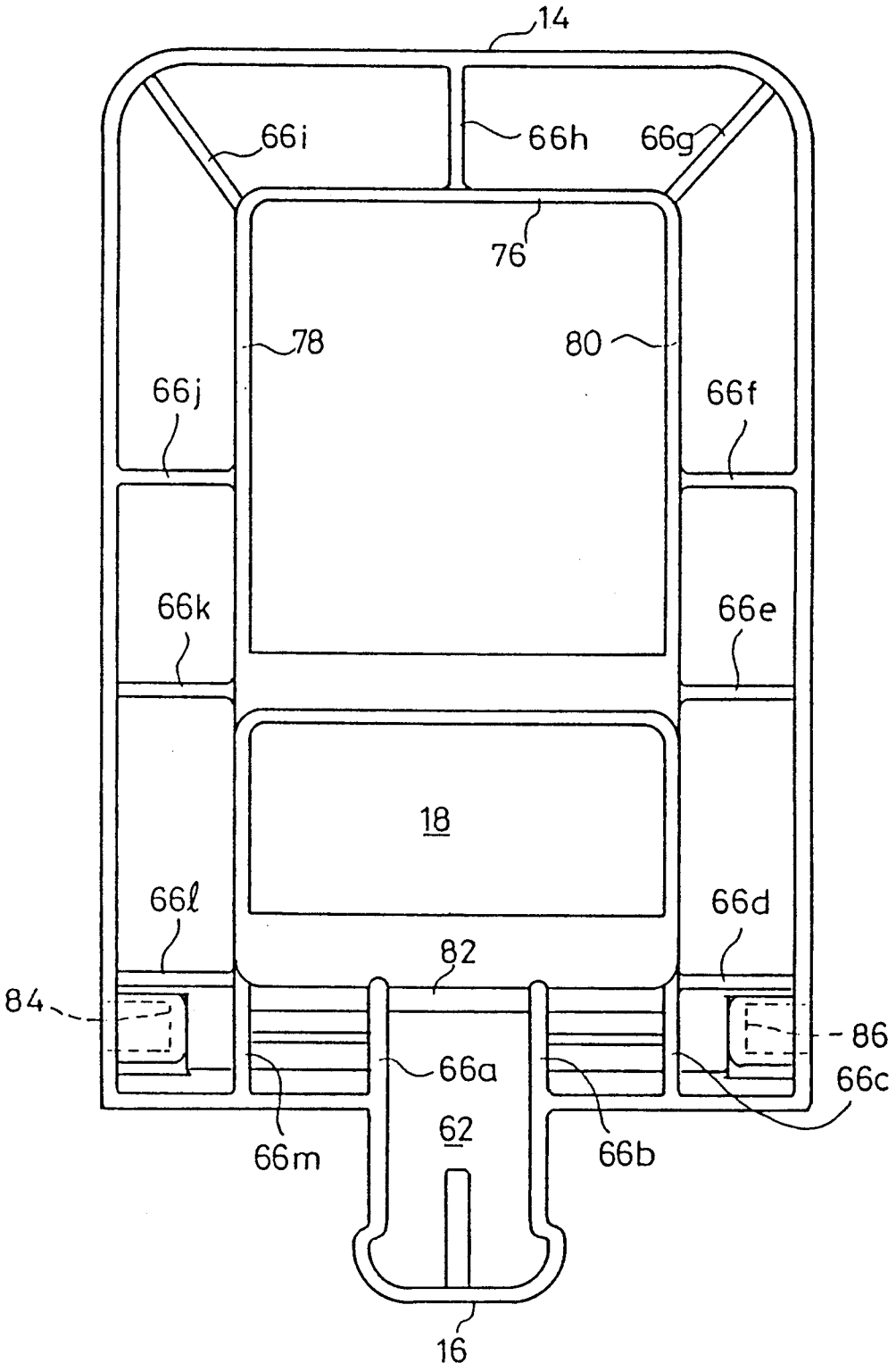
FIG. 6 illustrates a bottom view of the handle.
Figure 7:
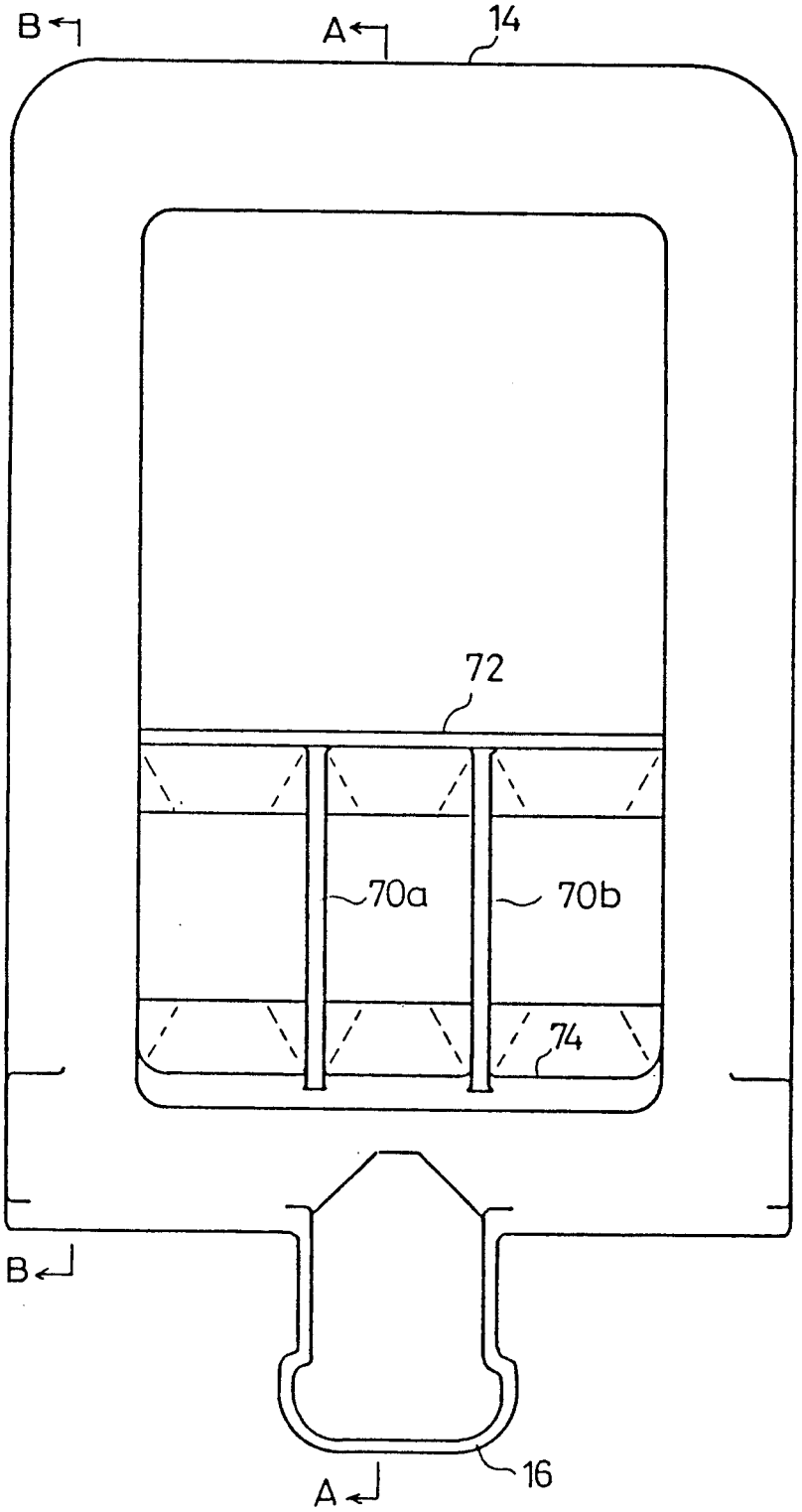
FIG. 7 illustrates a top view of the handle.

FIG. 6 illustrates a bottom view of the handle 14 including an extending crimping member 16 with a mold void 62, the flat surface 18, a gripping handle surface 64 as illustrated in FIG. 7, reinforcing members 66*a*–66*n* and mold voids 68*a*–68*n*. The handle 14 includes a U-shaped member 76 with legs 78 and 80, and an end member 82 with opposing pivot pin holes 84 and 86.

FIG. 7 illustrates a top view of the handle 14 where all numerals correspond to those elements previously described. Reinforcing members 70*a* and 70*b* extend between members 72 and 74.

Figure 8:
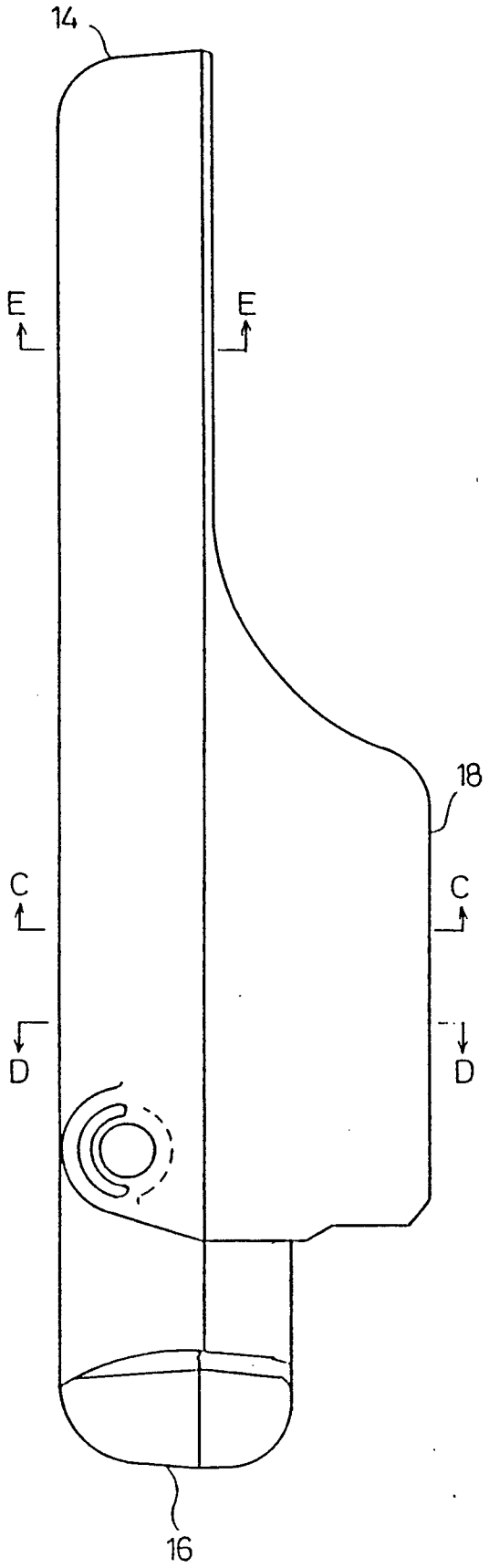
FIG. 8 illustrates a side view of the handle.

FIG. 8 illustrates a side view of the handle 14 where all numerals correspond to those elements previously described.

Figure 9:
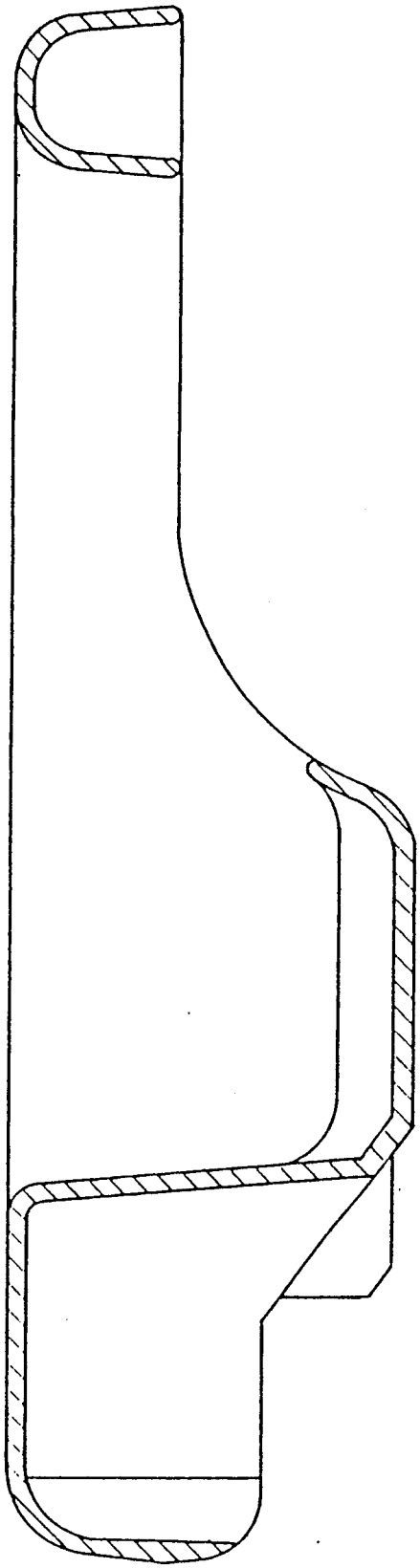
FIG. 9 illustrates a view taken along line A—A of FIG. 7.

FIG. 9 illustrates a view taken along line A—A of FIG. 7 where all numerals correspond to those elements previously described.

Figure 10:
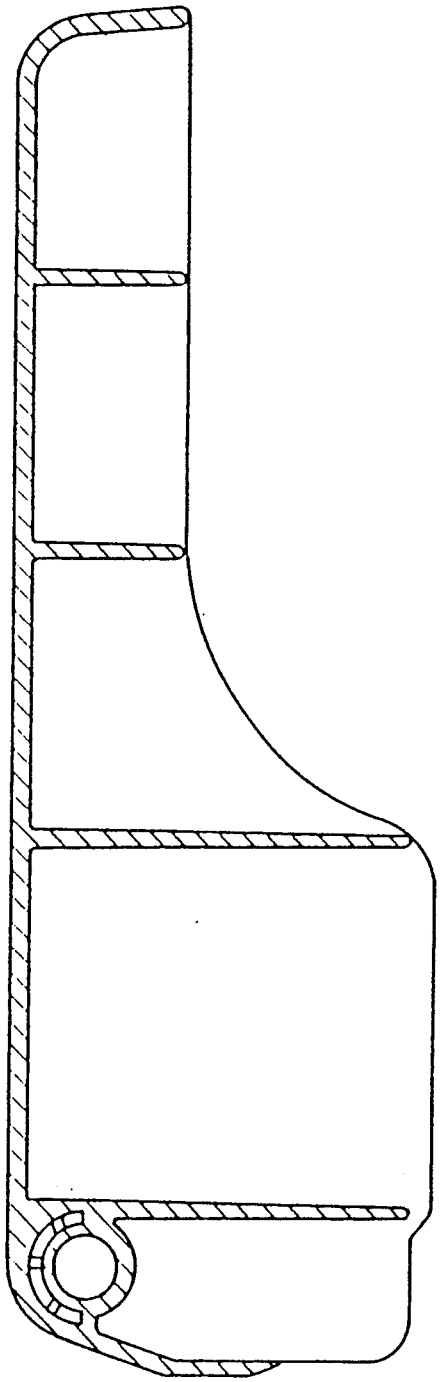
FIG. 10 illustrates a view taken along line B—B of FIG. 7.

FIG. 10 illustrates a view taken along line B—B of FIG. 7 where all numerals correspond to those elements previously described.

Figure 11:
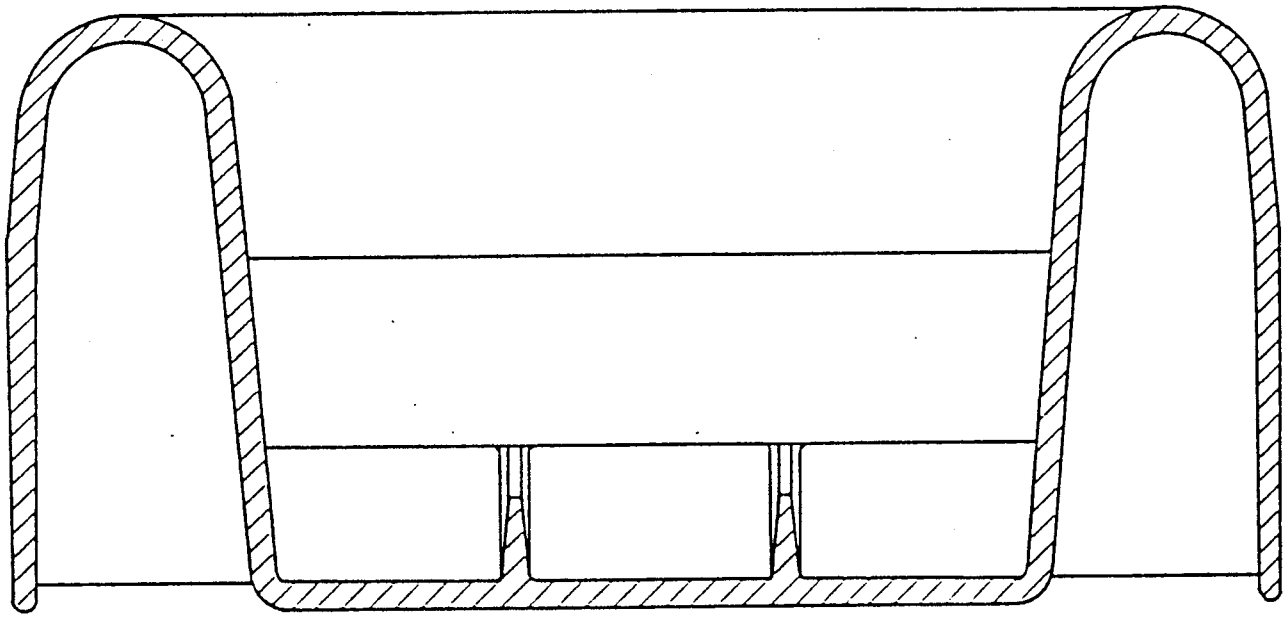
FIG. 11 illustrates a view taken along line C—C of FIG. 9.

FIG. 11 illustrates a view taken along line C—C of FIG. 9 where all numerals correspond to those elements previously described.

Figure 12:
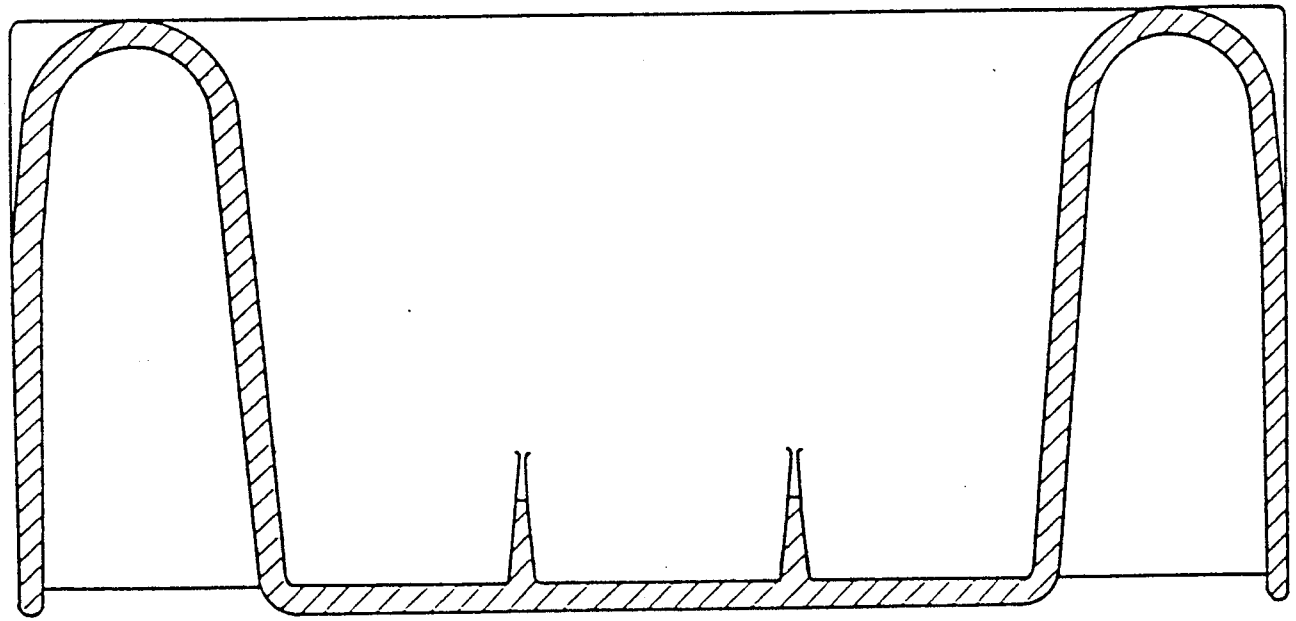
FIG. 12 illustrates a view taken along line D—D of FIG. 8.

FIG. 12 illustrates a view taken along line D—D of FIG. 8 where all numerals correspond to those elements previously described.

Figure 13:
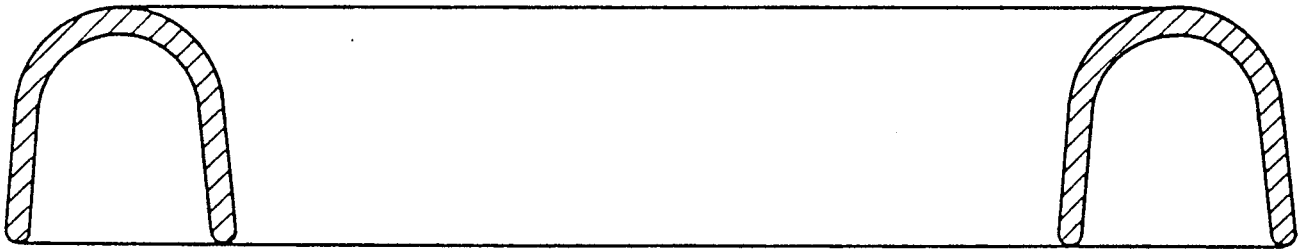
FIG. 13 illustrates a view taken along line E—E of FIG. 8.

FIG. 13 illustrates a view taken along line E—E of FIG. 8 where all numerals correspond to those elements previously described.

Figure 14:
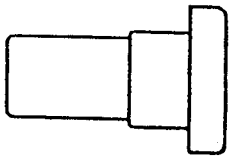
FIG. 14 illustrates a side view of the pivot pin.

FIG. 14 illustrates a side view of the pivot pin where all numerals correspond to those elements previously described. The pivot pin is solid and of a decreasing radius structure as illustrated in the figure.

Figure 15:
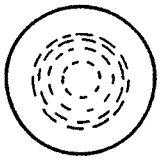
FIG. 15 illustrates a top view of the pivot pin.

FIG. 15 illustrates a top view of the pivot pin where all numerals correspond to those elements previously described.

MODE OF OPERATION

Figure 16:
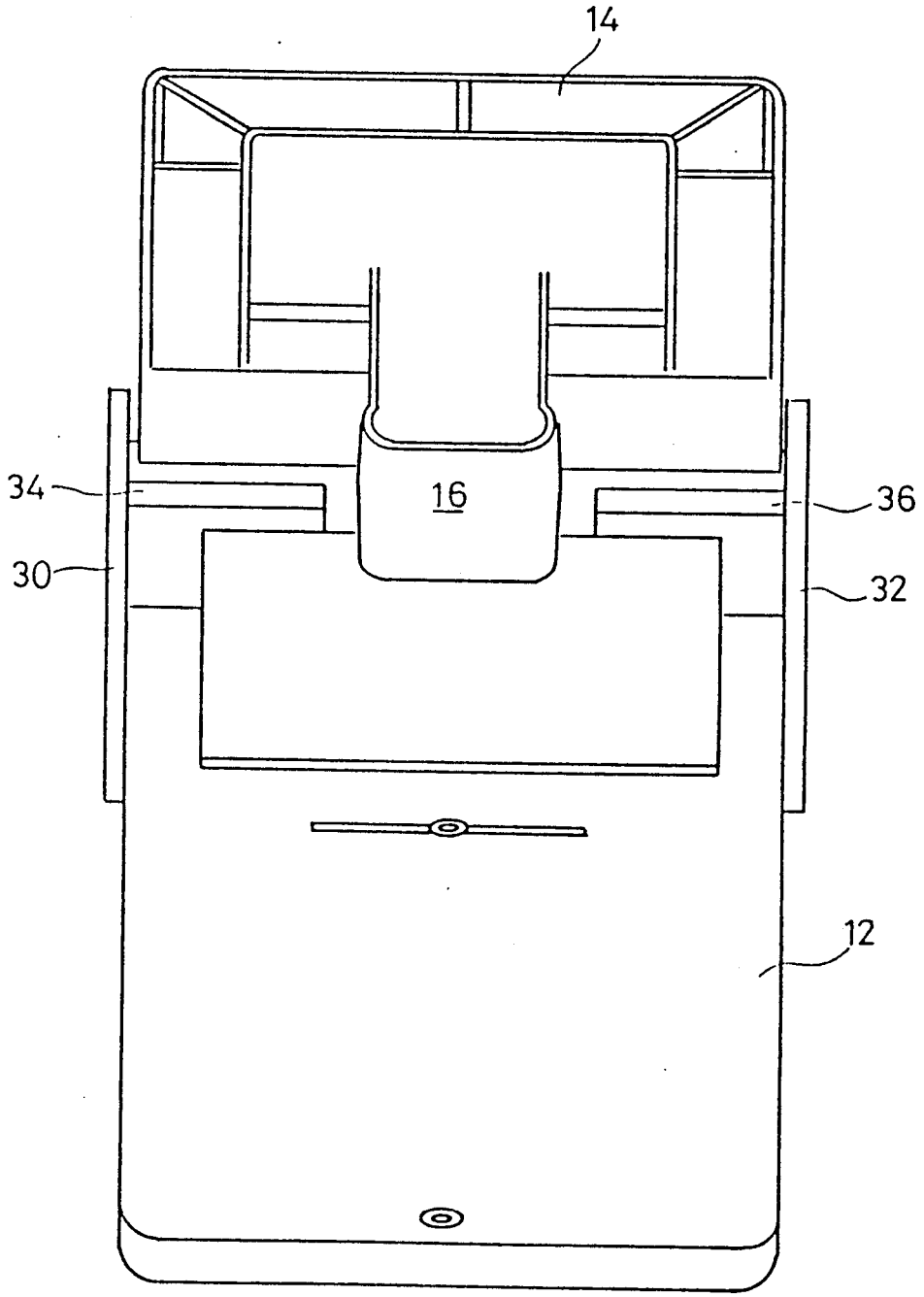
FIG. 16 illustrates the can crusher with a can prior to engaging in a crushing operation and the extending crimping member of the handle touching the can.

FIG. 16 illustrates the can crusher 10 with a can prior to engaging in a crushing operation.

Figure 17:
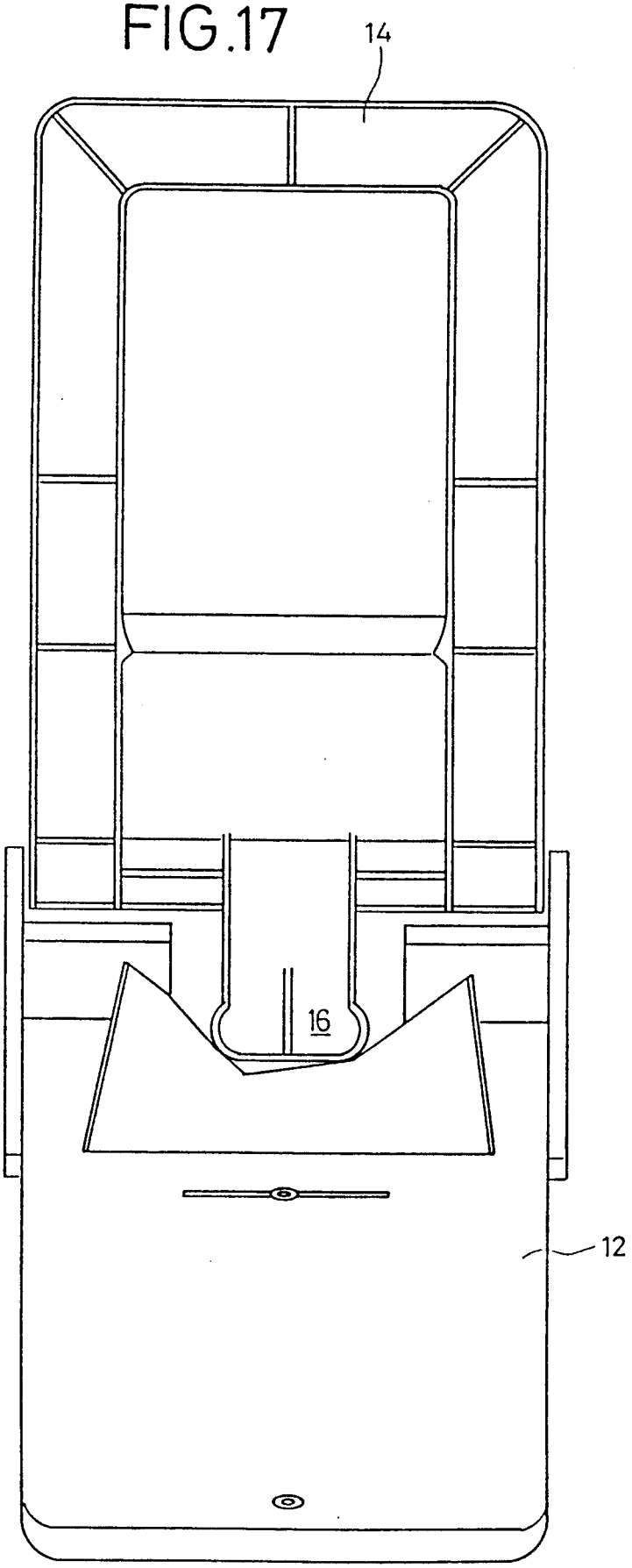
FIG. 17 illustrates a can crusher with the handle partially depressed and the extending crimping member of the handle passing through a mid-portion of the can; and, FIG. 18 illustrates the can crusher with the handle depressed significantly downwardly and the flat surface of the handle squashing the ends of the can downwardly forming a substantially flat can for recycling or disposal.

FIG. 17 illustrates the can crusher 10 with the handle 14 partially depressed so that the extending crimping member 16 presses the center portion of the can downwardly and the ends of the can likewise follow inwardly in a rotational direction towards the center portion of the can. The crushing of the center of the can causes the ends to rotate inwardly toward each other and inwardly towards the center of the can. There is a combined motion of depressing the center of the can towards itself, thereby causing inward rotational travel of the ends of the can towards each other prior to the flattening of the ends of the can and flattening of the can itself.

Figure 18:
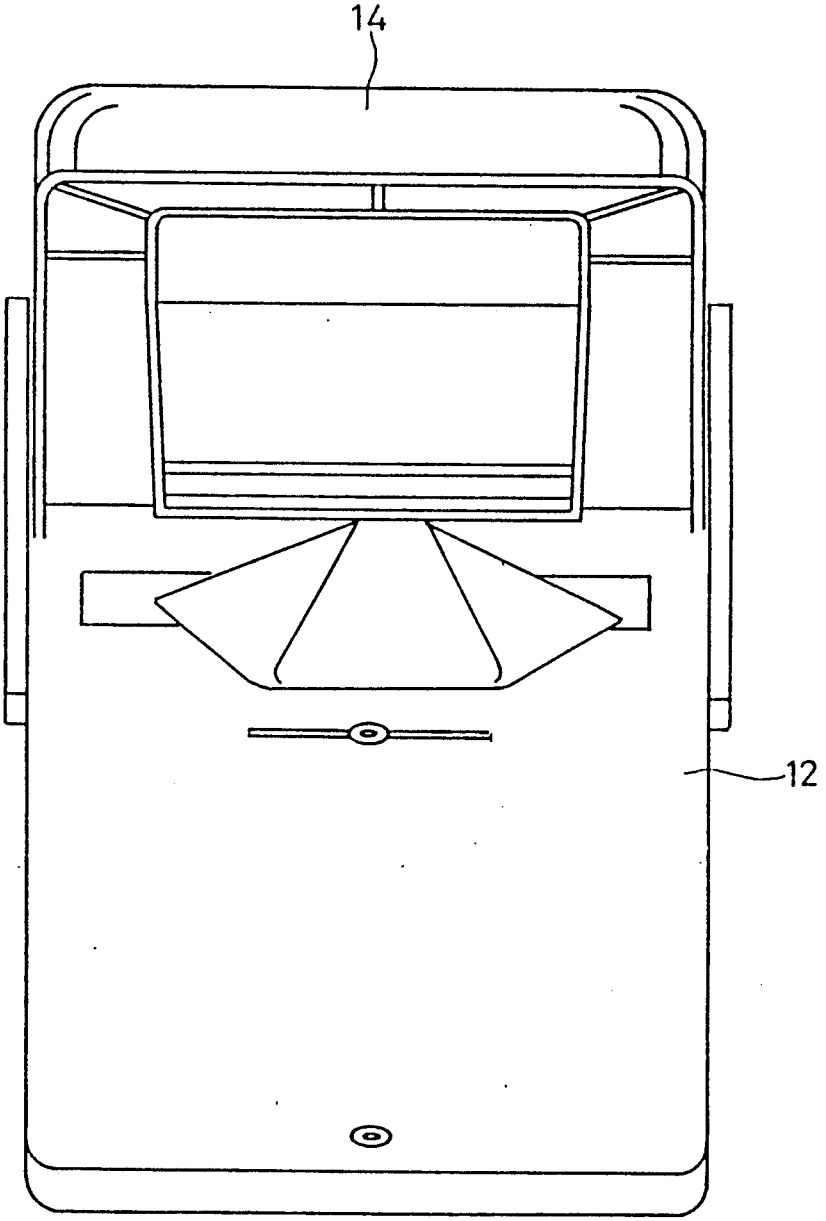

FIG. 18 illustrates the can crusher 10 with the handle 14 depressed significantly downwardly so that the flat surface 18 starts to flatten the ends of the can downwardly towards the center portion of the can with continued inward rotational arcuate travel of the ends of the can. The extending crimping member 16 has now rotated in an arcuate path past the center of the can, and the flat surface 18 now acts against the ends of the can to push the ends downwardly towards the mid-portion of the can to form a substantially flat package of the can for recycling or disposal. The crimping member, on reverse rotation, assists in rejecting the crushed can outwardly from the can crusher for subsequent storage for recycling or disposal.

Various modifications can be made to the present invention without departing from the apparent scope hereof.

We claim:

1. Can crusher for crushing a can including two ends comprising:

a. a flat base with a curved area for retaining the can and with two opposing spaced flanges extending vertically upward from a rear portion of said base, two spaced can support members connected between end corners of said flat base and said opposing spaced flanges and opposing pivot pin holes in said flanges;

b. a U-shaped handle including spaced opposing legs and an end member connected to said opposing legs, a vertical end member secured to another end of said opposing legs, an extending crimping member with a rounded end extending rearwardly from a rear of said end member, and a lower flat surface extending between said vertical end member and a lower portion of each of said downwardly extending legs and in a lower plane with respect to a upper plane of said extending crimping member and substantially 180° opposite said extending crimping member; and, c. pivot pins rotationally securing opposing ends of said vertical end member of said U-shaped handle to said pivot pin holes of said spaced opposing flanges whereby first, said extending crimping member first rotates the ends of the can towards each other and simultaneously pressing the center of the can and second, said flat surface folds the ends of the can about the can when said U-shaped handle is rotated about said pivot pins.

2. Can crusher of claim 1 including a recessed area in said base for receiving the can.

3. In combination, a can and a can crusher comprising:

a. a can including a cylindrical member and two ends attached thereto; and, b. a flat base with a curved area for retaining said can and with two opposing spaced flanges extending vertically upward from a rear portion of said base, two spaced can support members connected between end corners of said flat base and said opposing spaced flanges and opposing pivot pin holes in said flanges; a U-shaped handle including spaced opposing legs and an end member connected to said legs, a vertical end member secured to another end of said opposing legs, an extending crimping member with a rounded end extending rearwardly from a rear of said end member, and a lower flat surface extending between said vertical end member and a lower portion of each of said opposing downwardly extending legs and in a lower plane with respect to a upper plane of said extending crimping member and substantially 180° opposite said extending crimping member; and, pivot pins rotationally securing opposing ends of said vertical end member of said U-shaped handle to said pivot pin holes of said spaced opposing flanges whereby first, said extending crimping member first rotates said ends of said can towards each other and simultaneously pressing the center of the can and second, said flat surface folds said ends of said can about said can when said U-shaped handle is rotated about said pivot pins.

4. Combination of claim 3 wherein said can is an aluminum can.

5. Combination of claim 3 wherein said can is a steel can.

6. Combination of claim 3 wherein said can is a pop can.

7. Combination of claim 3 wherein said can is a beer can.

* * * * *